US009453686B2

(12) United States Patent
You et al.

(10) Patent No.: US 9,453,686 B2
(45) Date of Patent: Sep. 27, 2016

(54) SELF-COOLING ENERGY SAVER

(71) Applicant: Shun-Fu International Electrical Co., Ltd., Taipei (TW)

(72) Inventors: Ming-Shun You, Taipei (TW); Wei-Ta Chou, Taipei (TW)

(73) Assignee: SHUN-FU INTERNATIONAL ELECTRICAL CO., LTD., Taipei (TW)

( * ) Notice: Subject to any disclaimer, the term of this patent is extended or adjusted under 35 U.S.C. 154(b) by 242 days.

(21) Appl. No.: 13/971,615

(22) Filed: Aug. 20, 2013

(65) Prior Publication Data

US 2015/0055298 A1 Feb. 26, 2015

(51) Int. Cl.

| | |
|---|---|
| ***F28D 15/00*** | (2006.01) |
| ***F28F 1/32*** | (2006.01) |
| ***H01F 27/12*** | (2006.01) |
| *F28D 21/00* | (2006.01) |

(52) U.S. Cl.

CPC ..... *F28D 15/00* (2013.01); *F28F 1/32* (2013.01); *H01F 27/12* (2013.01); *F28D 2021/0031* (2013.01)

(58) Field of Classification Search

CPC ..... H05K 7/20; H01F 27/04; H01F 27/40; H01F 29/02; H01F 29/04; H01F 27/14; H01F 27/10; H01F 27/02; H01H 9/00

USPC ..... 361/699; 165/47, 104.25, 108, 110; 174/15.1; 336/55, 57–61; 62/3.1, 119, 62/373

See application file for complete search history.

(56) References Cited

U.S. PATENT DOCUMENTS

| | | | | | |
|---|---|---|---|---|---|
| 1,539,837 | A * | 6/1925 | Hayes | H01F 27/12 | 137/147 |
| 1,798,702 | A * | 3/1931 | Roebel | F28F 27/00 | 165/104.31 |
| 3,564,386 | A * | 2/1971 | Leonard | H02M 7/10 | 174/139 |
| 3,585,552 | A * | 6/1971 | Feather | H01F 27/323 | 174/25 R |
| 6,568,287 | B2 * | 5/2003 | Golner | G01N 1/14 | 73/863.71 |
| 6,905,638 | B2 * | 6/2005 | Corkran | C09K 5/10 | 174/17 LF |
| 7,409,849 | B2 * | 8/2008 | Butler | H01F 27/14 | 336/57 |
| 7,902,951 | B2 * | 3/2011 | Findeisen | H01F 27/14 | 174/12 R |
| 8,000,102 | B2 * | 8/2011 | Johnston | B03C 3/68 | 336/65 |
| 8,305,178 | B2 * | 11/2012 | Yang | F28D 15/00 | 336/57 |
| 8,461,953 | B1 * | 6/2013 | Ward | H01F 27/08 | 336/55 |
| 8,963,677 | B2 * | 2/2015 | Xu | H01F 27/06 | 336/210 |
| 2007/0001793 | A1 * | 1/2007 | Magnier | H01F 27/402 | 336/90 |
| 2012/0247204 | A1 * | 10/2012 | Herz | G01N 33/2841 | 73/431 |
| 2012/0312515 | A1 * | 12/2012 | Nemec | F28F 3/022 | 165/170 |

* cited by examiner

*Primary Examiner* — Anthony Haughton
*Assistant Examiner* — Matt Dhillon
(74) *Attorney, Agent, or Firm* — Guice Patents PLLC

(57) ABSTRACT

A self-cooling energy saver includes a housing filled with insulating oil and having a plurality of conduits disposed on a first lateral side and a second lateral side thereof, a plurality of heat dissipation modules including a plurality of fins connecting corresponding conduits and heat dissipation flow path formed by adjacent fins; at least one input rod disposed on a top side of the housing and comprising a plurality of insulators; at least one output rod disposed on the top side of the housing and including a plurality of insulators; and an energy saving unit immersed in the insulating oil, electrically connected to the input rod and the output rod and comprising a plurality of reactance elements coupled to filter reactors electrically connected to a switch electrically connecting the reactance elements.

8 Claims, 5 Drawing Sheets

SELF-COOLING ENERGY SAVER

BACKGROUND OF THE INVENTION

1. Field of the Invention

The present invention relates to an energy saver, and in particular to an energy saver having a heat dissipation structure.

2. Description of the Related Art

As the cost of energy is increased, energy saving has become an important issue. The energy saving electrical products utilizing filter reactor are broadly applied in home and factory. The energy saver with reactance filtering is able to filter the harmonic interference and regulate the power to an appropriate value to improve the power factor of the load. Thus, a stable power is provided to equipments to save cost and extend the service life.

However, since energy savers require different filter reactor in different environments. For example, the filter reactor with high power factor is often required in a high interference environment to optimize the energy saving effect, which however often increases manufacture cost. At the same time, the single phase filter reactor must be separated from the three phase filter reactor, which causes inconvenience in use.

An improved structure for reactance filtering energy saving circuit is provided. A multistage switch is operated to change power factor of a first filter reactor and a second filter reactor according to different interference environment. The higher stages the switch is switched to, the power factor is greater. For example, in the high interference environment, the switch is operated to be switched to a higher stage to raise the power factor of the first filter reactor and the second filter reactor to obtain an excellent energy saving efficiency.

Although the reactance filtering energy saving circuit improves the drawbacks of conventional filter reactors, heat generated by circuits still affects the efficiency of the circuit.

SUMMARY OF THE INVENTION

It is one object of the present invention to provide a self-cooling energy saver having a heat dissipation structure disposed n a housing to maintain the efficiency of the energy saver.

To achieve this object of the present invention, one embodiment of a self-cooling energy saver includes a housing filled with insulating oil and having a plurality of conduits disposed on a first lateral side and a second lateral side thereof, a ground unit and a oil discharge valve disposed near a lower edge of a third lateral side thereof, a switch unit disposed on the third side and above the ground unit and the oil discharge valve and a oil level meter and a temperature meter disposed on the third lateral side and the switch unit disposed between the oil level meter and the temperature meter; a plurality of heat dissipation modules including a plurality of fins connecting corresponding conduits and heat dissipation flow path formed by adjacent fins; at least one input rod disposed on a top side of the housing and comprising a plurality of insulators; at least one output rod disposed on the top side of the housing and including a plurality of insulators; an energy saving unit immersed in the insulating oil, electrically connected to the input rod, the output rod and the switch unit and comprising a plurality of reactance elements coupled to filter reactors electrically connected to a switch electrically connecting the reactance elements.

In one embodiment of the present invention, two opposite edges of each fin are connected to the corresponding conduits.

In one embodiment of the present invention, the conduits are U shaped and each conduit has two ends connected to the housing.

In one embodiment of the present invention, the fins extend from the conduits.

In one embodiment of the present invention, the filter reactors are multistage filter reactors.

In one embodiment of the present invention, the switch is a multistage switch.

DETAILED DESCRIPTION OF THE PREFERRED EMBODIMENT

Figure 1:
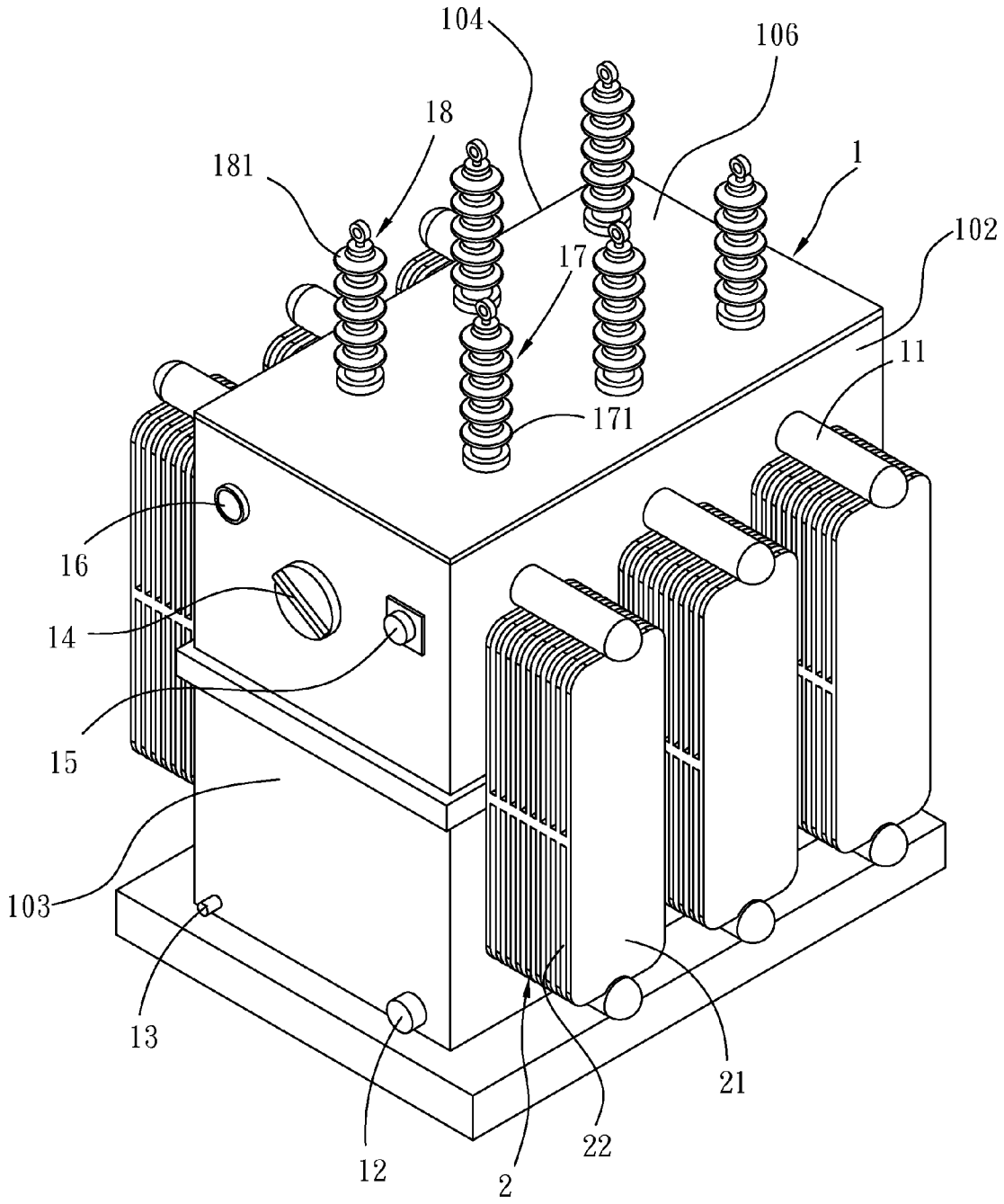
FIG. 1 is a perspective view of an embodiment of an energy saver of the invention.
Figure 2:
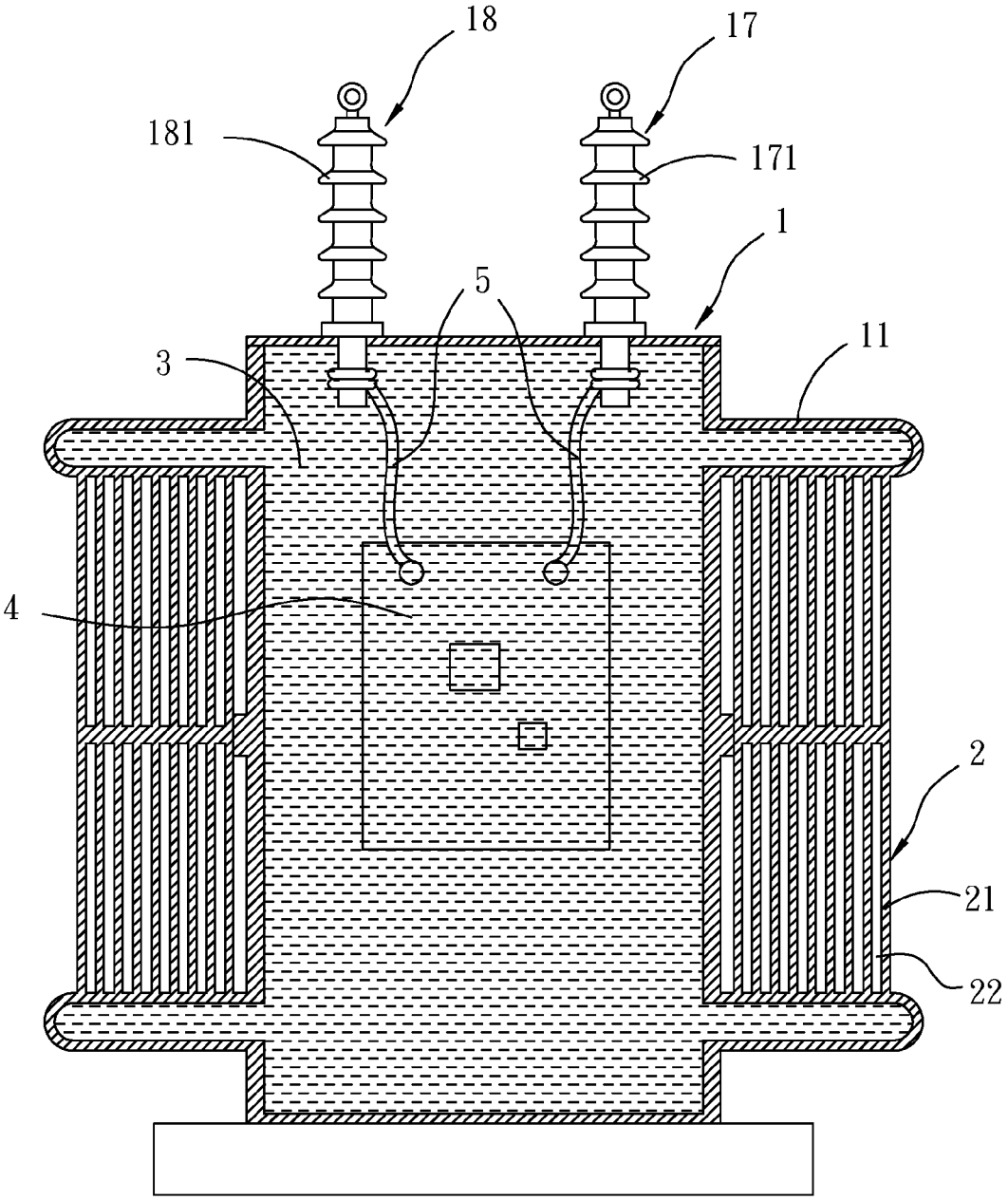
FIG. 2 is a cross section of an embodiment of an energy saver of the invention.

The invention is detailed described by the following embodiment in accompany with drawings, Referring to FIG. 1, an energy saver of the invention includes a housing 1 which is hollow and made of metal. The housing 1 has a first lateral side 102, a second lateral side 104 and a third lateral side 103. A plurality of conduits 11 made of metal are disposed on the first lateral side 102 and the second lateral side 104 with arranging in two rows on each lateral side 102 and 104 and extend from the first lateral side 102 and the second lateral side 104. A heat dissipation module 2 including a plurality of fins 21 is disposed between the two rows of conduits 11. Two opposite edges of each fin 21 abut the conduits 11. The gap between two adjacent fins 21 forms a heat dissipation flow path 22. An oil discharge valve 12 and a ground unit 13 are disposed on the third lateral side 103. A switch unit 14 is also disposed on the third lateral side 103 to control circuits in the energy saver. An oil level meter 15 and a temperature meter 16 monitoring conditions of insulating oil filled in the housing 1 are disposed on the third lateral side 103 in such a manner that the switch unit 14 is disposed between the oil level meter 15 and the temperature meter 16 as shown in FIG. 2. Three input rods 17 and three output rods 18 are disposed on a top side 106. Each input rod 17 includes several insulators 171, and each output rod 18 includes several insulators 181.

Figure 3:
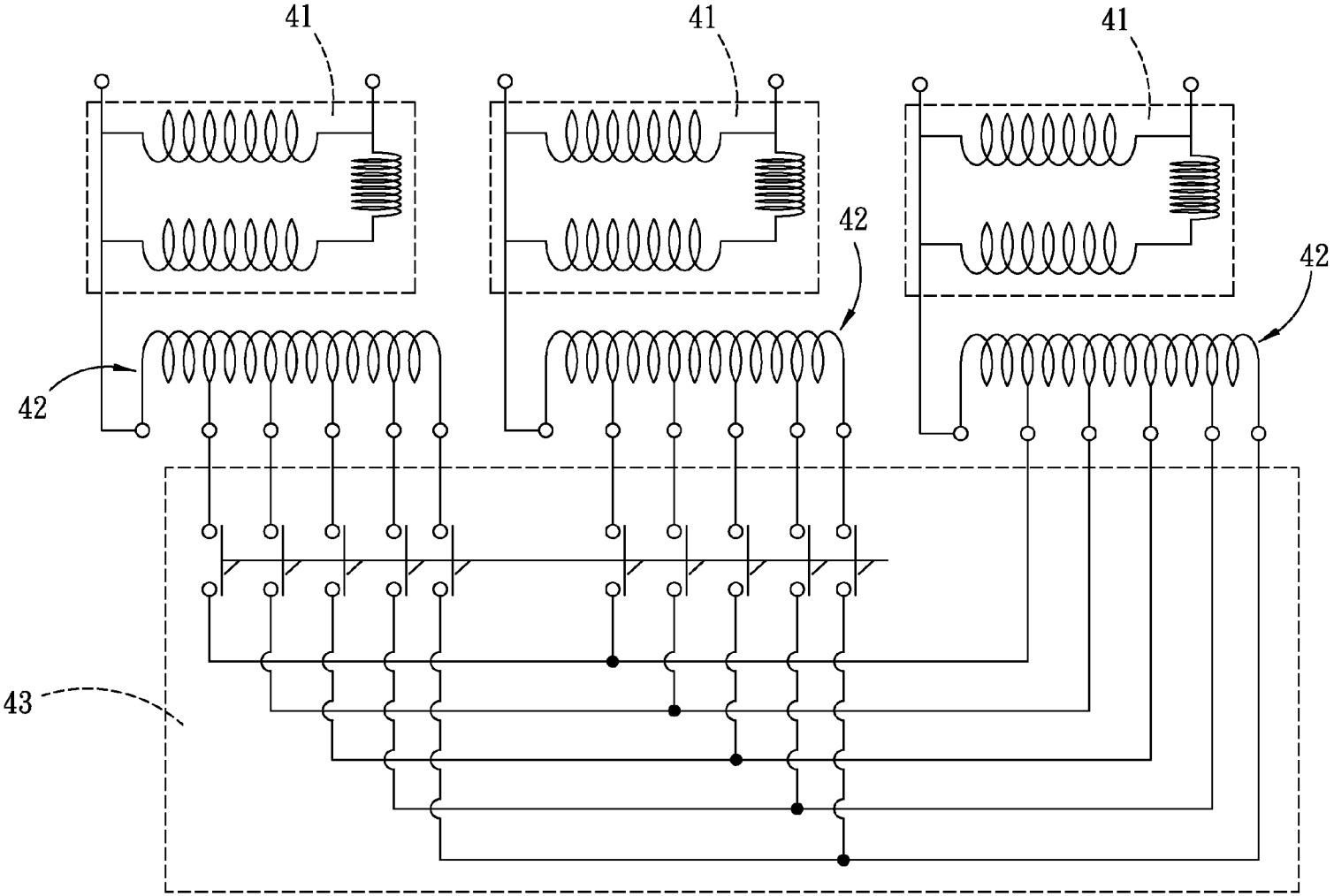
FIG. 3 is a circuit diagram of an energy saver of the invention.

Referring to FIG. 2, an energy saving unit 4 is disposed within the housing 1 and immersed in the insulating oil 3. The energy saving unit 4 is electrically connected to the input rods 17 and the output rods 18 via several leads 5 and also electrically connected to the switch unit 14. The energy saving unit 4 includes a plurality of reactance elements 41 as shown in FIG. 3. Each reactance element 41 is coupled to a filter reactor 42 respectively. The filter reactors 42 are electrically connected to a switch 43 so that each filter reactor 42 is electrically connected to each other. Reactive power in current flowing into the energy saver via the input rods 17 is eliminated by the energy saving unit 4. The current without reactive power is output via the output rods

18. In addition, the filter reactor 42 has multistage switching function. The switch 43 is also a multistage switch.

Figure 4:
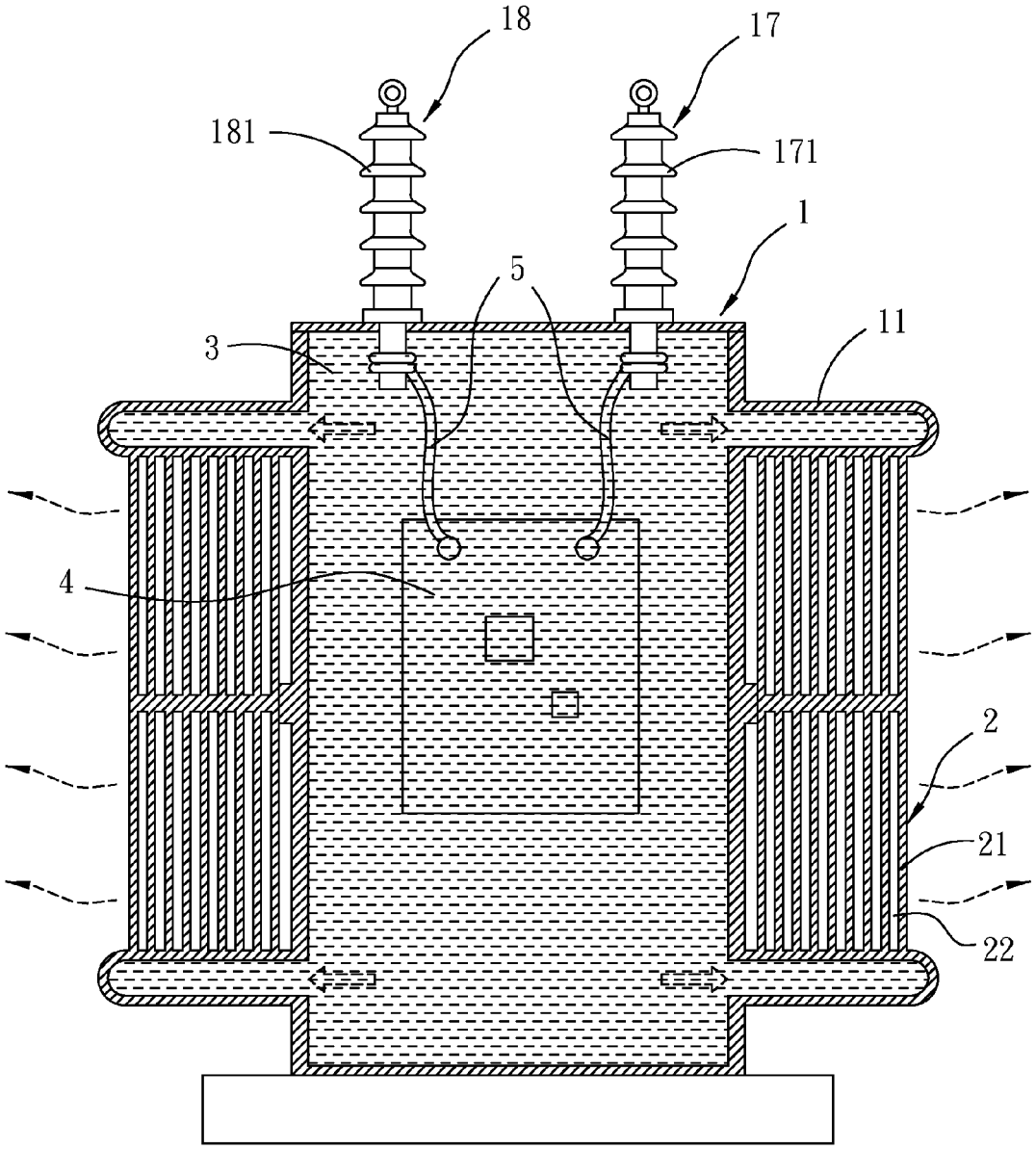
FIG. 4 is schematic view of heat dissipation of an energy saver of the invention.

Referring to FIG. 4, when the energy saver is operated, heat generated by the energy saving unit 4 is absorbed by the insulating oil 3. The heated insulating oil 3 flows to the conduits 11 due to temperature difference, and heat is thus transferred to the conduits 11 by heat convection and further conducted to the fins 21 connected to the conduits 11. Air flowing through the gap between the fins 21 brings heat from the fins 21 so as to maintain the temperature of the energy saver.

Figure 5:
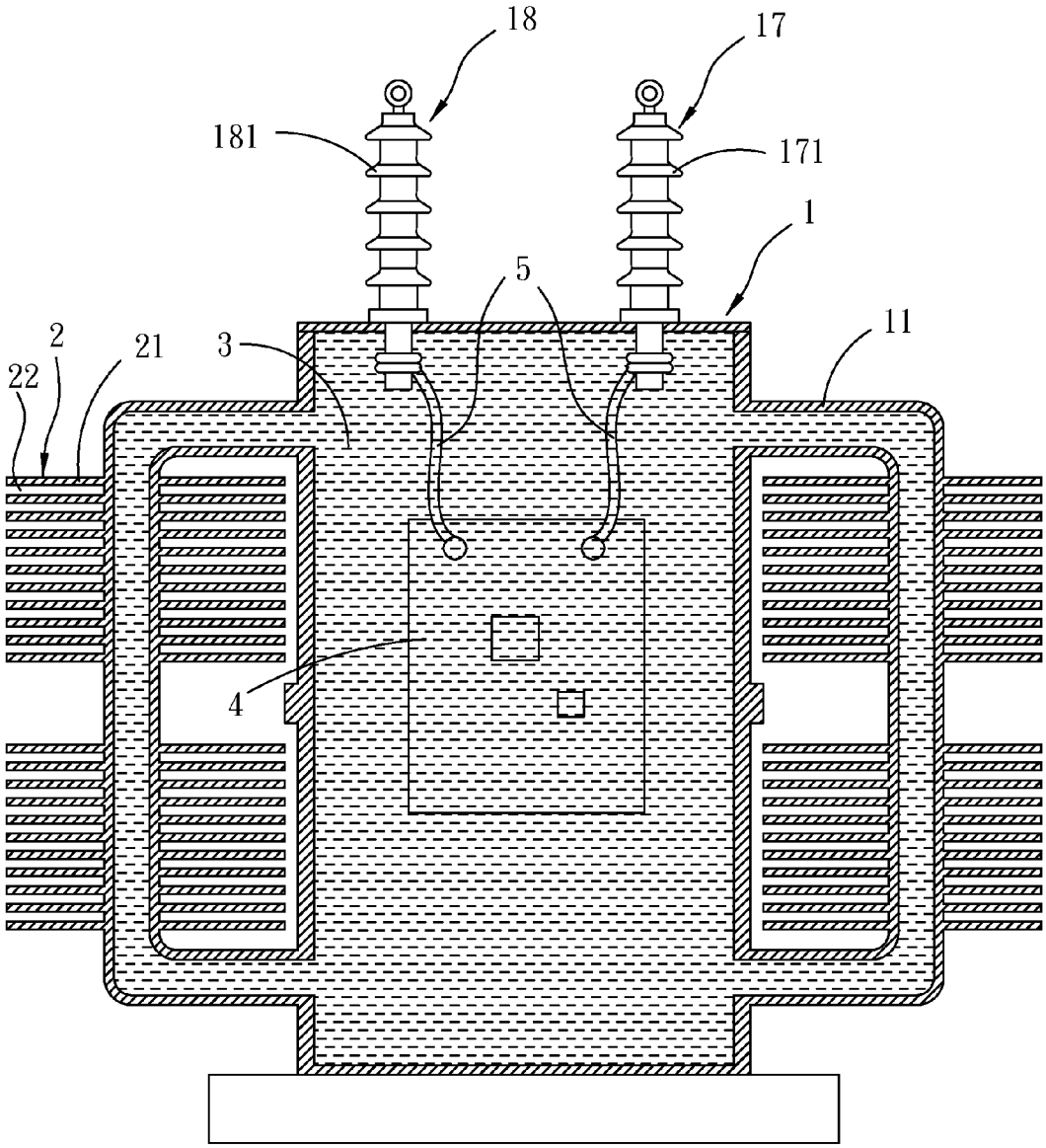
FIG. 5 is a cross section of another embodiment of an energy saver of the invention.

FIG. 5 depicts another embodiment of the energy saver of the invention. The conduits 11 are U shaped and each conduit 11 has two ends connecting the housing 1. The fins 21 extend from the conduits 11 and disposed parallel to each other. The gap between two adjacent fins 21 forms a heat dissipation flow path 22 to increase contact area of the fins 21 and the conduits 11 so as to provide heat dissipation path of the insulating oil 3.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A self-cooling energy saver, comprising:

a housing filled with insulating oil and having a plurality of conduits disposed on a first lateral side and a second lateral side thereof and a switch unit disposed on a third side;

a plurality of heat dissipation modules comprising a plurality of fins connecting corresponding conduits and heat dissipation flow path formed by adjacent fins;

at least one input rod disposed on a top side of the housing and comprising a plurality of insulators;

at least one output rod disposed on the top side of the housing and comprising a plurality of insulators; and an energy saving unit immersed in the insulating oil, electrically connected to the input rod, the output rod and the switch unit and comprising a plurality of reactance elements coupled to filter reactors electrically connected to a switch which electrically connects the reactance elements;

wherein each conduit of the plurality of conduits is U shaped, each said conduit has two opposing ends connected to the housing and an interior extending a length thereof and communicating with an interior of the housing at both of the two opposing ends;

wherein each said conduit has a middle portion located between the two opposing ends connected to the housing and the middle portion extending through selected fins of the plurality of fins, each said conduit has two horizontal portions extending horizontally and being located between the middle portion and the two opposing ends, the plurality of fins are spaced apart from the two horizontal portions each said conduit of the plurality of conduits;

wherein the two horizontal portions of each conduit of the plurality of conduits and the plurality of fins are parallel.

2. The self-cooling energy saver as claimed in claim 1, wherein the plurality of fins are located perpendicular to the first lateral side and the second lateral side of the housing.

3. The self-cooling energy saver as claimed in claim 2, wherein the fins extend from the conduits.

4. The self-cooling energy saver as claimed in claim 1, wherein the filter reactors are multistage filter reactors.

5. The self-cooling energy saver as claimed in claim 1, wherein the switch is a multistage switch.

6. The self-cooling energy saver as claimed in claim 1, wherein the housing further has a ground unit and an oil discharge valve disposed near a lower edge of a third lateral side thereof and below the switch unit.

7. The self-cooling energy saver as claimed in claim 1, wherein the housing further has an oil level meter and a temperature meter disposed on the third lateral side thereof, and the switch unit is disposed between the oil level meter and the temperature meter.

8. The self-cooling energy saver as claimed in claim 1, wherein the plurality of fins includes at least two groups of fins being spaced apart and respectively located on the first lateral side and the second lateral side of the housing.

* * * * *